US008644533B2

(12) United States Patent
Burns

(10) Patent No.: US 8,644,533 B2
(45) Date of Patent: Feb. 4, 2014

(54) METHOD AND APPARATUS FOR HEARING ASSISTANCE DEVICE MICROPHONES

(75) Inventor: Thomas Howard Burns, St. Louis Park, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 978 days.

(21) Appl. No.: 12/649,773

(22) Filed: Dec. 30, 2009

(65) Prior Publication Data

US 2010/0172531 A1 Jul. 8, 2010

Related U.S. Application Data

(60) Provisional application No. 61/142,177, filed on Dec. 31, 2008.

(51) Int. Cl.

| | |
|---|---|
| ***H04R 25/00*** | (2006.01) |
| *H04R 3/00* | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |

(52) U.S. Cl.
USPC ..... 381/313; 381/92; 381/312; 381/356; 381/357

(58) Field of Classification Search
USPC ..... 381/92, 312–331, 356, 357
See application file for complete search history.

(56) References Cited

U.S. PATENT DOCUMENTS

| | | | | |
|---|---|---|---|---|
| 3,798,390 | A * | 3/1974 | Gage et al. | 381/322 |
| 3,836,732 | A * | 9/1974 | Johanson et al. | 381/313 |
| 4,051,330 | A * | 9/1977 | Cole | 381/313 |
| 5,524,056 | A | 6/1996 | Killion et al. | |
| 5,878,147 | A | 3/1999 | Killion et al. | |
| 6,075,869 | A | 6/2000 | Killion et al. | |
| 6,101,258 | A | 8/2000 | Killion et al. | |
| 6,134,334 | A | 10/2000 | Killion et al. | |
| 6,151,399 | A | 11/2000 | Killion et al. | |
| 6,681,021 | B1 * | 1/2004 | Saltykov | 381/328 |
| 2008/0118080 | A1 * | 5/2008 | Gratke et al. | 381/86 |

OTHER PUBLICATIONS

Smela, Elisabeth, "Conjugated Polymer Actuators for Biomedical Applications", *Adv. Mater*, 15, No. 6, (Mar. 17, 2003), 481-494.

* cited by examiner

*Primary Examiner* — Duc Nguyen
*Assistant Examiner* — Matthew Eason
(74) *Attorney, Agent, or Firm* — Schwegman Lundberg & Woessner, P.A.

(57) ABSTRACT

One embodiment of the present subject matter includes an apparatus, including: a microphone to convert sound into a signal; and an electrically adjustable shutter including conductive polymer, the shutter in acoustic communication with the microphone and configured to provide an adjustable acoustic resistance to the microphone. Variations include conductive traces adapted to apply an electric signal to the conductive polymer. In some embodiments a diaphragm in acoustic communication with the shutter configured to detect acoustic energy is included. The present subject matter also provides methods including, but not limited to a method for operating a microphone in a hearing assistance device, including measuring acoustic energy detected by a diaphragm in acoustic communication with a shutter via a conduit, and controllably adjusting an acoustic resistance of the shutter with an electric signal to change directionality of the microphone.

20 Claims, 5 Drawing Sheets

METHOD AND APPARATUS FOR HEARING ASSISTANCE DEVICE MICROPHONES

CLAIM OF PRIORITY

The present application claims the benefit under 35 U.S.C. 119(e) of U.S. Provisional Patent Application Ser. No. 61/142,177, filed on Dec. 31, 2008, which is hereby incorporated by reference in its entirety.

TECHNICAL FIELD

This disclosure relates generally to microphones for hearing assistance devices, and more particularly to a microphone having an electroactive (conductive) polymer.

BACKGROUND

Hearing instruments generally offer both an omnidirectional and directional mode of operation. The omnidirectional mode is executed with a single omnidirectional microphone. The directional mode is often executed with a single, passive, differential microphone having both a front and rear acoustical conduit. The rear conduit may contain an acoustical resistance in the form of a screen or mesh that is engineered to provide a fixed sensitivity pattern such as a cardioid, hypercardioid, etc. Two separate microphones are thus used to provide the two modes of operation in a hearing instrument. There exists, therefore, a need for a system to provide both modes of operation in a smaller profile, at lower cost, with the option of adjusting the acoustical resistance by adjusting the orifice dimensions electromechanically. There also exists a broad class of materials referred to as electroactive, conductive, or conjugated polymers that can be electrically controlled to produce large linear, volumetric, or bending strains when configured as an actuator under a DC voltage. These electroactive polymers (EAP) can be configured to operate as an acoustical valve in a small, low-cost, omni and directional microphone system.

SUMMARY

The above-mentioned problems and others not expressly discussed herein are addressed by the present subject matter and will be understood by reading and studying this specification.

One embodiment of the present subject matter includes an apparatus, including: a microphone to convert sound into a signal; and an electrically adjustable shutter including conductive polymer, the shutter in acoustic communication with the microphone and configured to provide an adjustable acoustic resistance to the microphone. Variations include conductive traces adapted to apply an electric signal to the conductive polymer. In some embodiments a diaphragm in acoustic communication with the shutter configured to detect acoustic energy is included. Different positions of the microphone and shutter are provided in various embodiments. Different types of hearing assistance devices are configured with the apparatus in various embodiments. In various embodiments a first and second conduit configuration of varying spacings are employed. In various embodiments a conductive mesh is used in conjunction with the apparatus.

The present subject matter also provides methods including, but not limited to a method for operating a microphone in a hearing assistance device, including measuring acoustic energy detected by a diaphragm in acoustic communication with a shutter via a conduit, and controllably adjusting an acoustic resistance of the shutter with an electric signal to change directionality of the microphone. In some embodiments the method further includes applying the electric signal to stacked electroactive polymer membranes to control the acoustic resistance. In some embodiments, the method includes applying the electric signal to a linear longitudinal or bending biomorph to control the acoustic resistance.

One embodiment of the present subject matter includes an apparatus for controlling the acoustic resistance of sound traveling through a sound conduit by having an EAP actuator located within the sound conduit extending from a microphone to the exterior of a hearing-aid housing.

The present subject matter includes several variations. In some embodiments, the EAP actuator is contained within a housing that is designed to mate with an existing microphone. In additional embodiments, the EAP actuator is at least partially adapted to an existing microphone but may alternatively be integrated within the microphone itself.

Additionally, an embodiment of the present subject matter includes an apparatus for a hearing assistance device, the apparatus having a hearing aid housing containing a microphone, a sound conduit acoustically sealed to the aperture in the hearing aid housing containing an electrically adjustable EAP shutter to control acoustic resistance traveling through the sound conduit. In addition, a method of adjusting the acoustic resistance of the shutter to change directionality of a microphone is provided.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter

DETAILED DESCRIPTION

The following detailed description of the present invention refers to subject matter in the accompanying drawings which show, by way of illustration, specific aspects and embodiments in which the present subject matter may be practiced.

These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The present subject matter is directed toward microphones. Among the many applications of microphones there are included hearing assistance devices. Such applications include a microphone used in a configuration of one or more passageways, or conduits, adapted to allow propagation of acoustic wavefronts. Some systems are designed to filter or attenuate the sound transmitted through the conduit as a means to control the sounds heard by the user. For instance, some hearing aids provide a fixed filter maintained within the conduit to limit certain frequencies within a given range, thereby blocking unwanted frequencies, or noise, that falls outside this range. This method does not provide the ability to change the filter response, once installed, reducing its adaptability to a changing user's needs. In various embodiments, the present subject matter provides a solution which provides electrical adjustability. Additionally the present subject matter maintains a low profile for application in hearing assistance devices and reduces cost.

Figure 1:
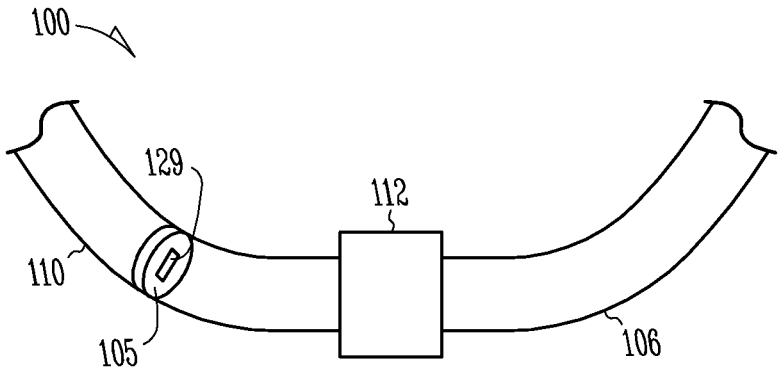
FIG. 1 shows a microphone having two air channels and a shutter, according to one embodiment of the present subject matter.

FIG. 1 shows an illustration of an air conduit assembly 100, including a microphone 112, a first sound conduit 110, a shutter 105, and a second sound conduit 106. The illustration further shows an aperture 129 within the shutter 105, which may include a fixed opening size or allow adjustability. In one embodiment, the air channel assembly 100 can be sized to fit within a hearing assistance device, or hearing aid. It is within the scope of the present subject matter for the distance between the first conduit 110 and second conduit 106 to be at least 0.25". In accordance with one embodiment, the distance between the first conduit 110 and second conduit 106 is about 0.41".

Figure 2:
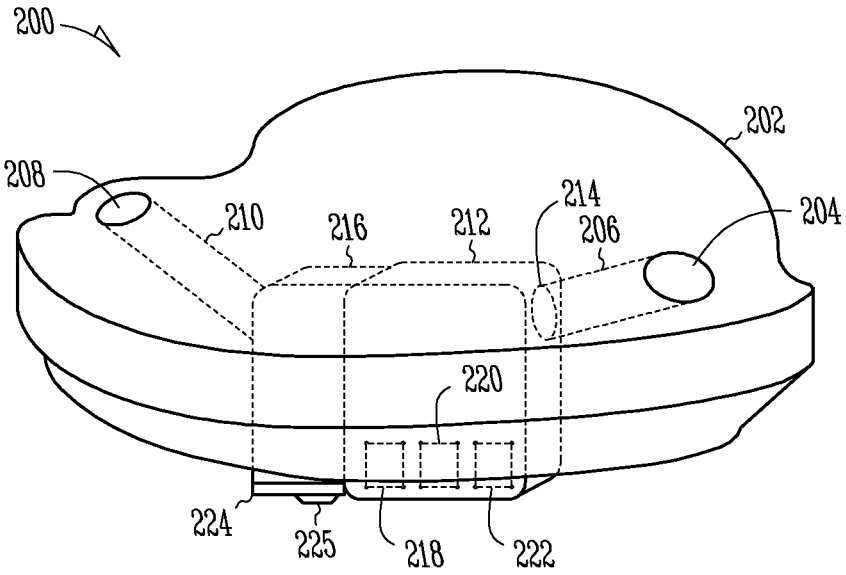
FIG. 2 shows a microphone with a shutter as assembled within the faceplate for a hearing aid, according to one embodiment of the present subject matter.

FIG. 2 provides a perspective view of a sound module 200 and additional components that comprise the air conduit assembly, similar to that shown in FIG. 1. This configuration comprises a rear conduit 210 within housing 202 which extends between a rear opening 208 and a shutter 216. The shutter 216 is adapted to provide an acoustic seal with microphone 212. At the base of the shutter 216 is an electrical interface plate 224, having electrical contacts 225. The outer surface of the microphone 212 contains solder pads 218, 220 and 222 for electrical connectivity. On the side of the microphone 212 that is opposite the shutter 216 is a front sound conduit 206 within housing 202. The front conduit 206 extends between the sound port, or aperture 214 of microphone 212 and front opening 204.

In one embodiment the sound module 200 is sized to fit within the faceplate of a hearing aid. In various examples, the hearing aids which house the sound module 200, are shaped to fit almost completely within the ear canal. This configuration is known in the art as a completely-in-the-canal ("CIC") configuration. Optional configurations within the scope of the present subject matter extend beyond such embodiments using CIC housings. According to one embodiment of the present subject matter, the hearing aid which houses the sound module 200 is designed to fit at least partially within the ear canal. This configuration is known in the art as an in-the-canal ("ITC") configuration. In one embodiment of the present subject matter, the hearing aid which houses the sound module 200 is designed to fit at least partially behind an ear. This configuration is known in the art as a behind-the-ear ("BTE") configuration.

In some hearing aid designs, the front sound conduit 206 and rear sound conduit 210 are integrated within the housing 202. As such, in embodiments having the front sound conduit 206 or rear sound conduit 210 integrated within the housing 202, the front opening 204 and the rear opening 208 define an aperture in the hearing aid housing 202. Overall, the present subject matter includes embodiments in which the sound conduits provide an acoustically-sealed passageway for sound to propagate through the hearing aid housing 202.

In various examples, the conduits comprise hollow tubing, suited for acoustic seal attachment between the opening of the hearing aid housing 202 and microphone 212, or equivalent assembly. Some embodiments include conduit tubing which is made of a conformable substance equivalent to rubber.

Figure 3:
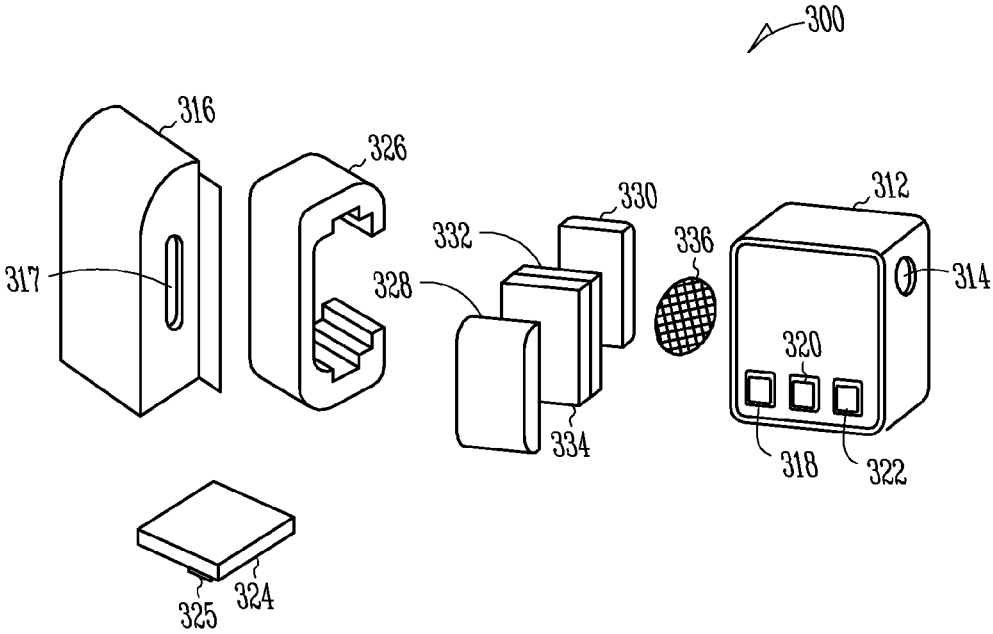
FIG. 3 illustrates an assembly of a shutter mechanism and microphone, according to one embodiment of the present subject matter.

FIG. 3 illustrates one configuration of a shuttered microphone assembly 300, similar to that shown in FIG. 2. This embodiment includes a microphone 312 having at least one aperture 314 and solder pads 318, 320 and 322 for electrical connectivity. The electroactive polymer ("EAP") assembly includes retaining clip 326, inside of which fits a biomorph actuator with an EAP back membrane 332 and an EAP front membrane 334. The EAP back membrane 332 and EAP front membrane 334 are positioned between two low-density compliant fillers, front pillow 328 and back pillow 330. In one embodiment, the low-density filler, similar to front pillow 328 and back pillow 334, are formed from gel or foam material that is easily conformable in response to bending deflection in the EAP actuator, thereby creating an adjustable acoustic valve opening. In various embodiments, the adjustable acoustical valve's dimensions are controlled to provide an adjustable acoustical resistance, thereby providing an adjustable polar sensitivity pattern.

In another embodiment shown in FIG. 3, acoustical resistance mesh 336 is attached on the exterior of microphone 312 to cover the rear microphone aperture (not shown). When EAP the EAP actuator assembly is opened, the acoustic wavefront propagates through resistance mesh 336 and into microphone 312.

Acoustical mesh 336 is engineered to provide a fixed acoustical resistance, thereby providing a fixed polar sensitivity pattern.

According to one embodiment of the present subject matter, module housing 316 is used to contain the EAP assembly, which includes retaining clip 326 with EAP back membrane 332, EAP front membrane 334, front pillow 328 and back pillow 330. The side of module housing 316 contains an aperture 317 for establishing acoustic communication between the EAP material, including top membrane 332 and bottom membrane 334, and the microphone 312. Base plate 324 is attached to the base portion of the module case 316 and further contains electrical contact 325 for supplying electrical potential to the EAP top membrane 332 and EAP bottom membrane 334. In one embodiment, the applied potential to contact 325 will induce a density change within the EAP material, resulting in an adjusted acoustic resistance.

Figure 4:
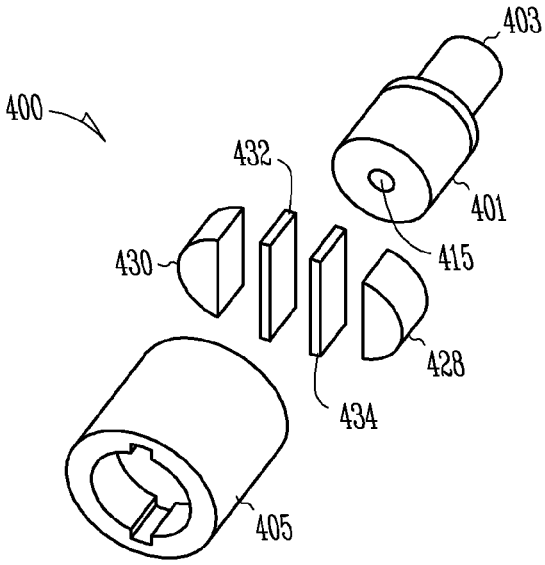
FIG. 4 is a perspective view of a shutter adaptor assembly, according to one embodiment of the present subject matter.

FIG. 4 shows a perspective view of an EAP actuator assembly 400, according to one embodiment of the present subject matter. Microphone 401 includes front spout 403 which can be adapted to fit any particular aperture size to which microphone 401 will mate. Microphone 401 further includes rear aperture 415 for providing acoustic communication to be transmitted to the conductive polymer assembly, comprising back membrane 432 and front membrane 434, positioned between front pillow 428 and back pillow 430. The actuator housing 405 is used to hold the conductive polymer assembly and align it over the rear aperture 415 of microphone 401 and to fit over at least a portion of microphone 401 and sufficient to seat the conductive polymer assembly against aperture 415. In some embodiments, the actuator housing 405 is plastic. In additional embodiments, shutter adaptor assembly 400 is metal. Some embodiments include a shutter adaptor assembly 400 made from machined steel.

Figure 5A:
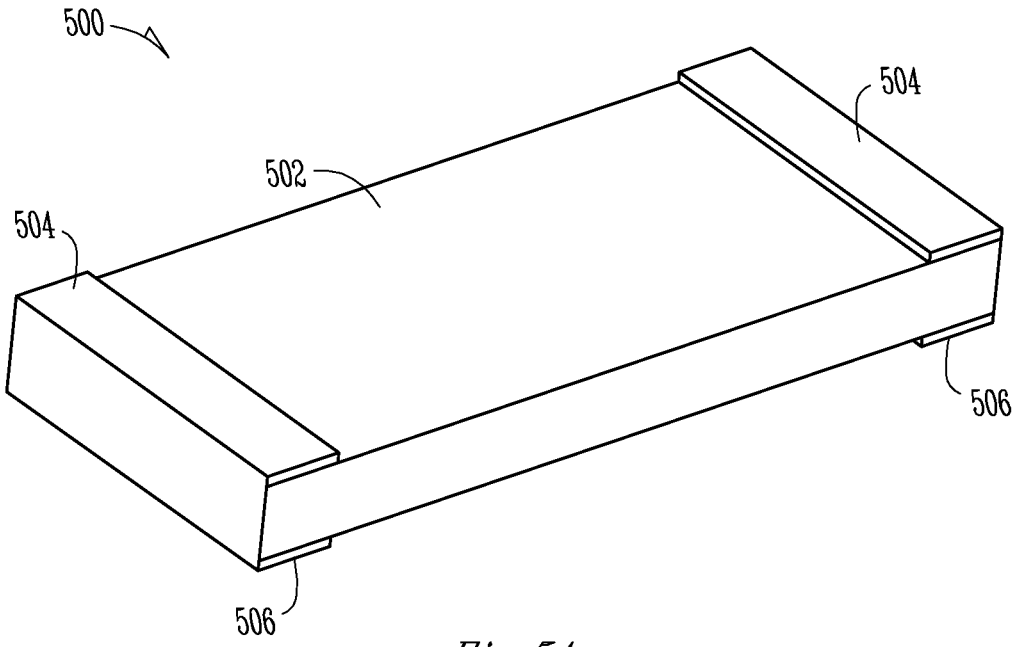
FIGS. 5A and 5B show a electroactive polymer assembly, according to one embodiment of the present subject matter.
Figure 5B:
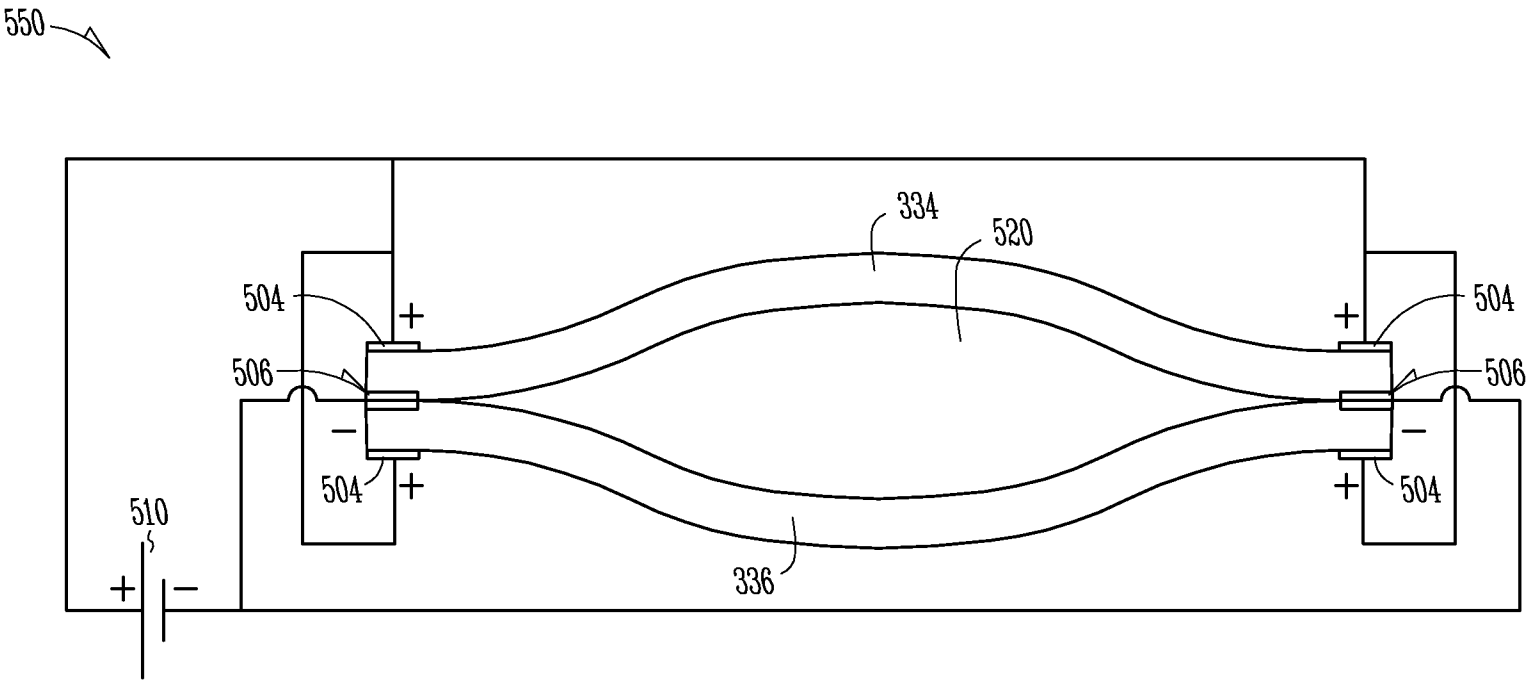

FIG. 5A shows a perspective view of an EAP membrane assembly 500, according to one embodiment of the present subject matter. The EAP membrane 502 includes two electrical trace anodes 504 and two electrical trace cathodes 506. Each trace is bonded to EAP membrane 502 via metal deposition, conductive ink, or any other equivalent process. FIG. 5B shows a side view of an EAP actuator assembly 550 in an actuated/open state, according to one embodiment of the present subject matter. A top EAP membrane 334 is stacked above a bottom EAP membrane 336 to form an EAP actuator 550. Each electrical trace anode 504 is aligned externally on EAP actuator 550, and each electrical trace cathode 506 is aligned internally on EAP actuator 550 to create a common cathode. Voltage potential 510 is applied to common anode 504 and common cathode 506, thereby causing the EAP actuator 550 to open, thereby creating sound conduit 520. It will be appreciated by those of ordinary skill in the art that other actuator configurations, including linear longitudinal or bending biomorph, can be used to create sound conduit 520.

Figure 6:
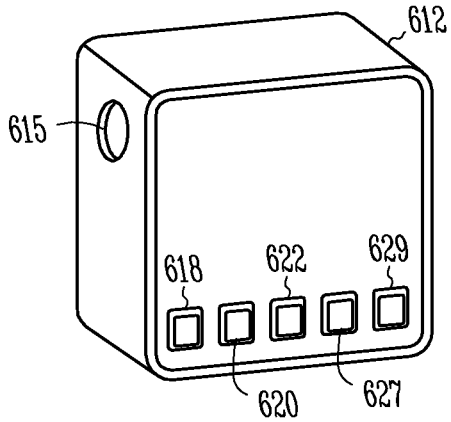
FIG. 6 illustrates a microphone having built-in shutter capability, according to one embodiment of the present subject matter.

FIG. 6 illustrates one configuration of a microphone 612 having the conductive EAP actuator integrated within the microphone 612 itself. Aperture 615 allows sound waves to propagate into microphone 612. Solder pads 618, 620 and 622 provide electrical connectivity to microphone 612. The additional solder pads 627 and 629 represent the electrical connectivity for actuator control as provided by supporting control circuitry.

Figure 7:
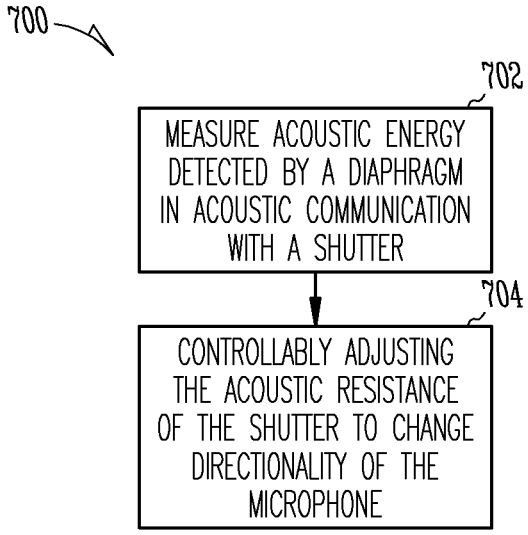
FIG. 7 is a flow diagram illustrating the method of adjusting acoustic resistance, according to one embodiment of the present subject matter.

FIG. 7 shows a flow diagram 700 illustrating the method of adjusting acoustic resistance, according to one embodiment of the present subject matter. The method includes a measuring step 702 for measuring the acoustic energy detected by the diaphragm in acoustic communication with a shutter. The method further includes an adjusting step 704 for controllably adjusting the acoustic resistance of the shutter to change directionality of the microphone. One should note that the present subject matter is useful in a variety of applications to include use with existing hearing aids, new hearing aids, use as new assemblies for attachment to housings, use as retrofit kits, and other uses. In various embodiments, the present subject matter includes components made from plastic or rubber and in some instances there may be a need to include an acoustic seal, such as o-rings. O-rings made from rubber fall within the present scope of such embodiments, however additional materials are also possible. Further, some embodiments include a washer. Some of these embodiments include a washer having a low durometer rubber. Other sealing methods, including films, adhesives, compression fittings, and other sealing technologies additionally fall within the present scope.

The present subject matter includes hearing assistance devices, including but not limited to, cochlear implant type hearing devices, hearing aids, such as in-the-ear (ITE), in-the-canal (ITC), completely-in-the-canal (CIC), behind-the-ear (BTE), and receiver-in-the-ear (RIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid, comprising:

a microphone to convert sound into a signal;

an electrically adjustable shutter including conductive polymer; and electronics configured to process the signal to provide gain to correct hearing loss and to control an opening of the shutter to provide a plurality of opening dimensions of the shutter, wherein the shutter is in acoustic communication with the microphone to provide an adjustable acoustic resistance to the microphone.

2. The hearing aid of claim 1, further comprising conductive traces adapted to apply an electric signal to the conductive polymer.

3. The hearing aid of claim 1, further comprising a diaphragm in acoustic communication with the shutter, wherein the diaphragm is configured to detect acoustic energy.

4. The hearing aid of claim 1, wherein the microphone and shutter are positioned in a faceplate of the hearing aid.

5. The hearing aid of claim 4, wherein the hearing aid is a completely-in-the-canal hearing assistance device.

6. The hearing aid of claim 4, wherein the hearing aid is an in-the-canal hearing aid.

7. The hearing aid of claim 4, wherein the hearing aid is a behind-the-ear hearing aid.

8. The hearing aid of claim 4, wherein the hearing aid is an in-the-ear hearing aid.

9. The hearing aid of claim 4, wherein the hearing aid is a receiver-in-the-ear hearing aid.

10. The hearing aid of claim 1, wherein the conductive polymer is ionic.

11. The hearing aid of claim 1, wherein the microphone is in communication with a first conduit and a second conduit, the first conduit including a first opening for reception of sound, the second conduit including a second opening for reception of sound.

12. The hearing aid of claim 11, wherein the first conduit and the second conduit are spaced apart at a distance of at least 0.25".

13. The hearing aid of claim 11, wherein the first conduit and the second conduit are spaced apart by a distance of about 0.41".

14. The hearing aid of claim 11, wherein the first opening and the second opening reside in a faceplate of the hearing aid.

15. The hearing aid of claim 1, wherein the shutter comprises a fixed opening size.

16. The hearing aid of claim 1, further comprising an acoustical resistance mesh attached on an exterior of the microphone.

17. The hearing aid of claim 1, wherein the shutter is integrated into the microphone.

18. A method for operating a microphone in a hearing assistance device, comprising:

measuring an acoustic signal detected by a diaphragm in acoustic communication with an electrically adjustable shutter via a conduit, the shutter including conductive polymer;

processing the measured acoustic signal to provide gain to correct hearing loss; and controllably adjusting an opening of the shutter to provide a plurality of open dimensions of the shutter, to adjust an acoustic resistance of the shutter with an electric signal to change directionality of the microphone.

19. The method of claim 18, further comprising applying the electric signal to stacked electroactive polymer membranes to control the acoustic resistance.

20. The method of claim 18, further comprising applying the electric signal to a linear longitudinal or bending biomorph to control the acoustic resistance.

* * * * *